US007056199B2

(12) United States Patent
Valentini

(10) Patent No.: US 7,056,199 B2
(45) Date of Patent: Jun. 6, 2006

(54) CONNECTING FOOT FOR ORBITAL MOVEMENT MACHINES FOR MACHINING SURFACES, IN PARTICULAR ORBITAL SANDERS, AND ORBITAL SANDING MACHINE USING THE SAID FOOT

(76) Inventor: Guido Valentini, Via Gioberti, 2, 20123 Milan (IT) I-20123

( * ) Notice: Subject to any disclaimer, the term of this patent is extended or adjusted under 35 U.S.C. 154(b) by 57 days.

(21) Appl. No.: 10/776,764

(22) Filed: Feb. 11, 2004

(65) Prior Publication Data

US 2004/0166786 A1 Aug. 26, 2004

(30) Foreign Application Priority Data

Feb. 13, 2003 (IT) ..... MI20030054 U

(51) Int. Cl.
*B24B 23/00* (2006.01)

(52) U.S. Cl. ..... 451/357; 451/351; 451/356

(58) Field of Classification Search ..... 451/351, 451/356, 357, 353, 359
See application file for complete search history.

(56) References Cited

U.S. PATENT DOCUMENTS 4,232,980 A * 11/1980 Tertinek et al. ..... 404/112
4,905,772 A * 3/1990 Honsa et al. ..... 173/162.1
5,536,025 A * 7/1996 Landay ..... 280/11.225
6,039,639 A 3/2000 Pfaundler
6,447,383 B1 * 9/2002 Oda et al. ..... 451/357
2001/0003087 A1 6/2001 Oda et al.

FOREIGN PATENT DOCUMENTS

DE 3514560 A1 10/1986
JP 3-62074564 * 4/1987

* cited by examiner

*Primary Examiner*—Eileen P. Morgan
(74) *Attorney, Agent, or Firm*—Arnold B. Silverman; Robert A. Diaz; Eckert Seamans Cherin & Mellott, LLC

(57) ABSTRACT

The present discovery refers to a connecting foot for a machine constituted by a central cylinder of hard plastic material, possibly fitted with a hole, coaxial to said central cylinder, and by an external coating of rubber. Said rubber also fills the hole forming a rod that connects the two heads of the external coating. The external coating of the foot is constituted by a single piece that completely covers the internal cylinder. An orbital sanding machine is also described, comprising a machine body that supports a motor for the rotation of a vertical shaft, a rotative-orbital plate connected eccentrically to said shaft by means of an eccentric hub in relation to the axis of the shaft and elastic connecting feet between the operating plate and the machine body. Said connecting feet comprise an internal cylinder of hard plastic and a rubber coating and in addition a rubber ring is provided for, which surrounds the feet group so as to prevent the reaction torques applied to the plate from modifying the initial set-up of the plate itself and also thanks to a conveyor it creates an area protected from the dust, inside which the feet are placed.

7 Claims, 3 Drawing Sheets

CONNECTING FOOT FOR ORBITAL MOVEMENT MACHINES FOR MACHINING SURFACES, IN PARTICULAR ORBITAL SANDERS, AND ORBITAL SANDING MACHINE USING THE SAID FOOT

The present discovery refers to a connecting foot for orbital movement machines for machining surfaces, in particular orbital sanders, and orbital sanding machine using the said foot.

In orbital sanders it is normal to use connecting feet between the operating plate and the body of the machine that houses the mechanisms generating the motion.

Connecting feet for the above-mentioned machines comprising a central cylinder of relatively hard elastic material assembled with two more end cylinders of elastic material having a lower hardness are known.

Said end cylinders limit the vibrating effects due to the operation of the machine.

Connecting feet comprising a central metallic cylinder (for example aluminium) assembled with a couple of rubber O-rings positioned in the end part of said end cylinder are also known. In addition, said end cylinder comprises, at each end, a coaxial section with reduced diameter placed between said O-rings.

Said feet permit the reduction of the vibrations in the direction of the axis of the end cylinder and, consequently, the vertical vibrations of the operating plate, resulting in a more uniform orbital movement of said plate.

In addition, said feet permit the reduction of the negative effects deriving from the heat that is developed by the machine during the working phase and at the same time the wear of said O-rings is limited by the fact of being subjected only to compression.

In view of the state of the technique, a first object of the present discovery is to provide a connecting foot that shows constructive and functional advantages in comparison to said above-mentioned known feet.

A second object of the present discovery is to provide an orbital sanding machine that houses said feet and that is able thanks to them to limit the vibrations of the operating plate.

In accordance with the discovery said first object is achieved with a connecting foot characterised in that it comprises an internal cylinder of hard plastic and an external coating of rubber.

In accordance with the discovery said second object is achieved with an orbital sanding machine, comprising a machine body that supports a motor for the rotation of a vertical shaft, a rotating-orbital plate connected eccentrically to said shaft by means of a hub which is eccentric in relation to the axis of the shaft and elastic connecting feet between the operating plate and the machine body, characterised in that said connecting feet comprise an internal hard plastic cylinder and a rubber coating and is also provided with a rubber ring that surrounds the feet group so as to limit any possible side oscillations of the machine body.

The characteristics and advantages of the present discovery will appear even more evident from the following detailed description of an embodiment thereof illustrated as non-limitative example in the attached drawings, in which.

Figure 1:
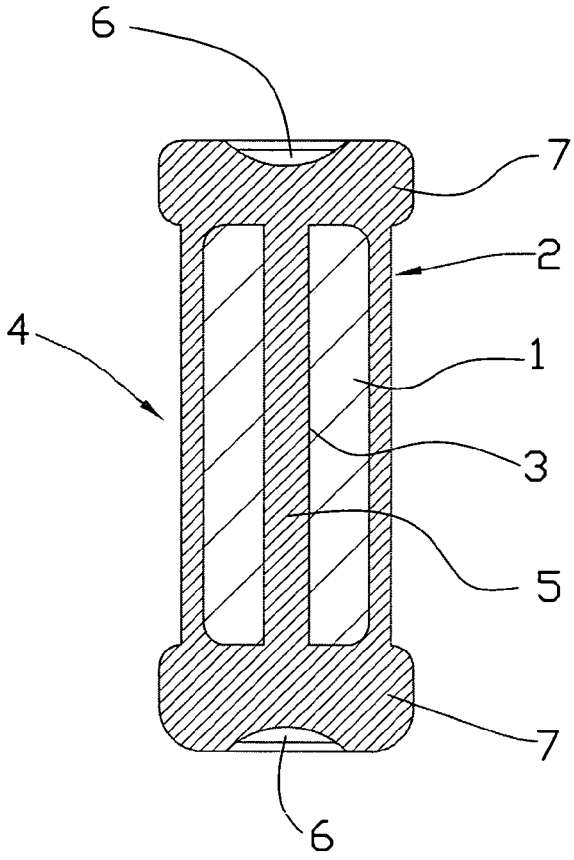
FIG. 1 shows a connecting foot in axial section according to the discovery.
Figure 2:
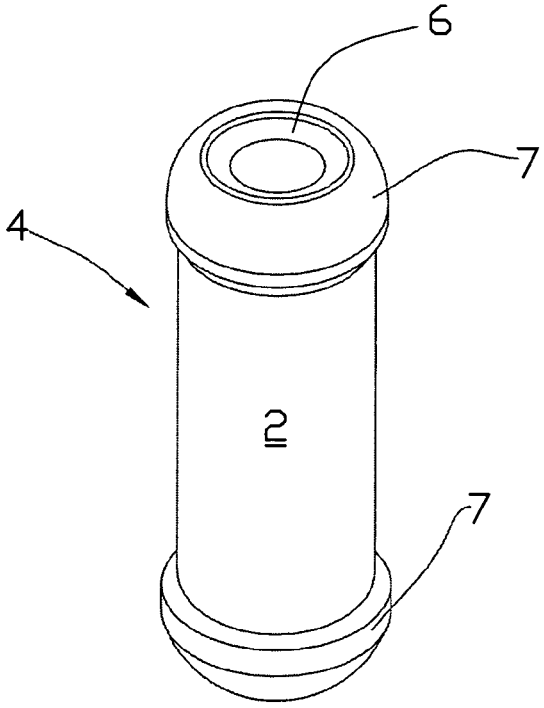
FIG. 2 shows the axonometrics of said foot.
Figure 3:
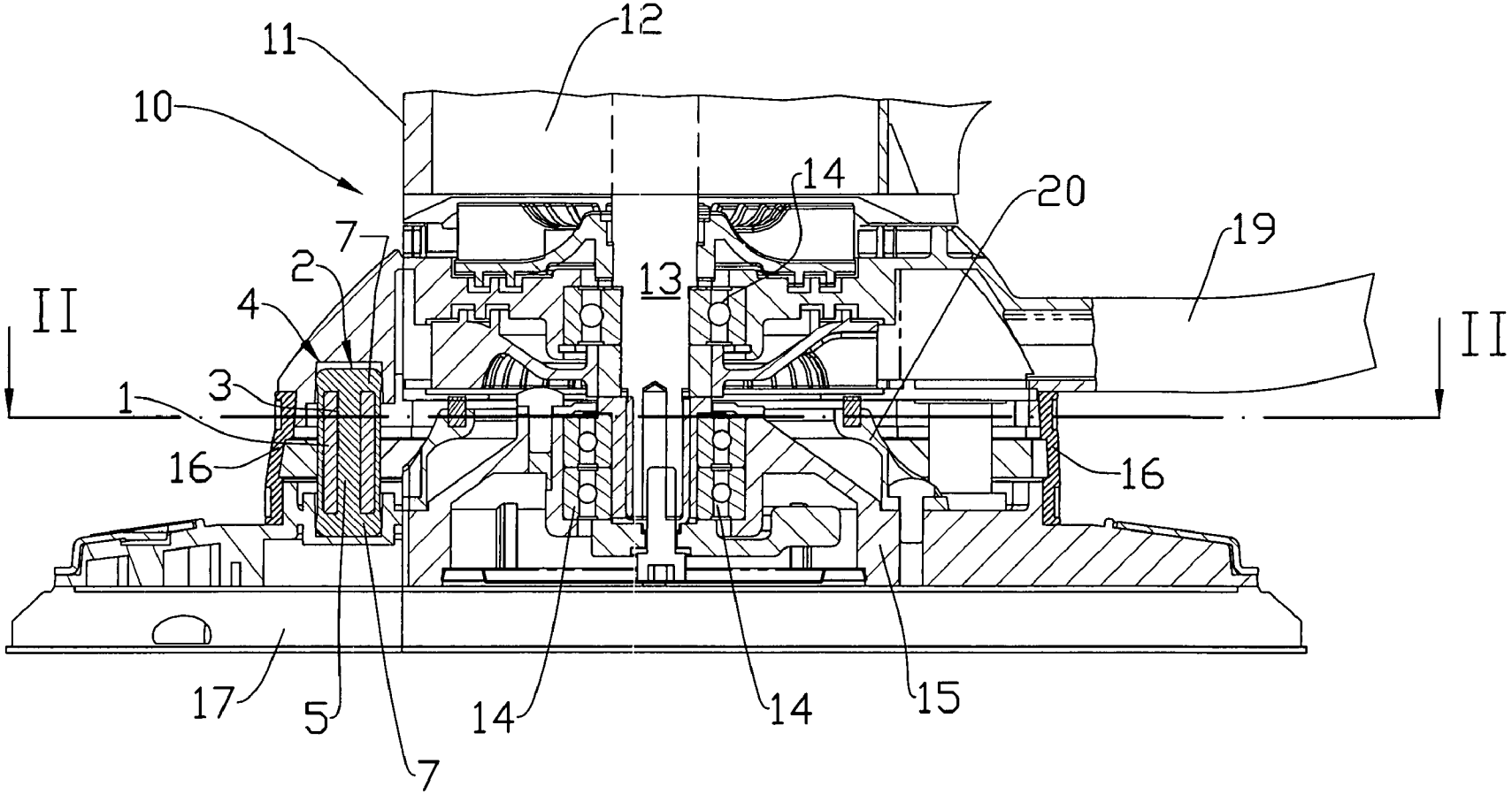
Figure 4:
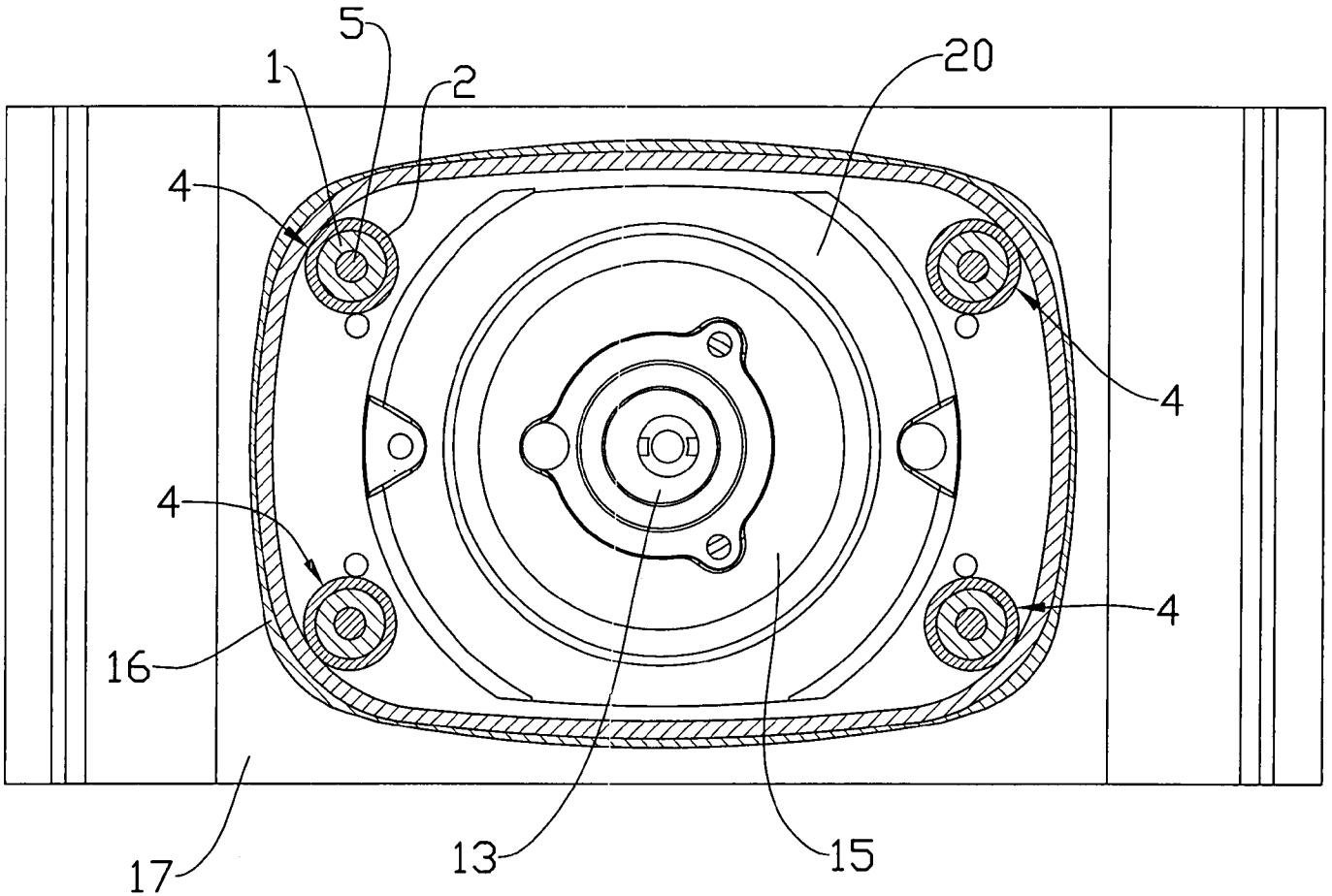

FIG. 3 partially shows in axial section an orbital sanding machine using connecting feet like that of FIGS. 1 and 2;

FIG. 4 shows said sander in section according to the line IV—IV of FIG. 3.

A connecting foot 4 is shown in the drawings for orbital sander or polisher or similar machine constituted by an end cylinder 1 of hard plastic material, preferably fitted with a hole 3, coaxial to said end cylinder, and an external rubber coating 2 with two end heads 7. Said rubber also fills the possible hole 3, of various diameter, forming a rod 5 that connects the two heads of the external coating 2. A concavity 6 of said heads of the rubber coating 2 is shown in the drawings.

The hole 3 is used as a channel for the flow of the liquid rubber during the moulding process of the connecting foot 4, that thus results in being constituted by one piece only and therefore cannot be dismounted as a consequence of stresses. This leads to greater durability of foot 4 and is consequently an advantage in economic terms.

In addition, the internal rod 5 gives extra rigidity to said connecting foot 4.

The concavity 6 increases the capacity of said foot 4 to resist against the vibrations in the direction of the axis of the foot 4 consequential to the orbital motion of the machine plate during the operation phase.

A further advantage of said foot 4 consists in its capacity to improve the elimination of the heat coming from the machine during the operative phase and this results in greater durability of the foot 4 itself.

FIGS. 3 and 4 instead show a sanding machine with rotating-orbital movement 10 comprising a machine body 11 that supports a motor 12 which, suitably fed by means that are not shown in the Figures, brings about the rotation of a vertical shaft 13.

Ball bearings 14 support said shaft 13 with which an eccentric hub 15 rotates integrally in relation to the axis of the shaft 13, that commands a rotative-orbital movement of plate 17 provided with holes for the passage of the dust, which is sucked from the working area and is sent to an external dust collection sack (not shown in the Figures) through ducts 19.

The plate 17 is connected to the machine body 11 by means of four feet 4 surrounded by a rubber ring 16, which limits the side oscillations.

When the machine is in the working phase the external power activates the motor 12 which makes the shaft 13 rotate and consequently also the eccentric hub 15. Because of the asymmetry of this hub the plate 17 moves with rotative-orbital motion.

The dust that is created in the working area is sucked up thanks to a sucking machine, which, through a conveyor 20 and ducts 19, directs the dust towards an external collection sack.

The working process could give rise to extremely annoying phenomena for the user such as axial vibrations and side oscillations.

As has already been mentioned, the feet 4 limit the axial vibrations, while the side oscillations (coplanar with the plate 17) are instead absorbed by the rubber ring 16 that surrounds the central area of the machine 10 also comprising the feet 4.

More precisely, the rubber ring 16 prevents the torque reaction applied to the plate 17 from modifying the initial set-up of the plate itself.

In addition, the rubber ring 16 mounted externally to the dust conveyor 20 creates an area protected from the dust, inside which the feet 4 work in clean air.

The invention claimed is:

1. A connecting foot for orbital movement machines for machining surfaces, in particular orbital sanders, characterised in that said foot is structured to connect an operating plate and a body of said machine, comprises;

an internal cylinder of hard plastic having an axial hole passing therethrough;

said internal cylinder having an external coating of rubber substantially surrounding said internal cylinder, said external coating of rubber having end heads located at opposite ends of said internal cylinder; and a rod of rubber being disposed within said axial hole of said internal cylinder, said rod of rubber being connected to each of said end heads.

2. The foot according to claim 1, wherein each of said end heads has an externally disposed generally concave depression.

3. The foot according to claim 1, wherein said external coating and said rod of rubber being unitary.

4. An orbital sanding machine, comprising:

a machine body that supports a motor for the rotation of a vertical shaft;

a rotative orbital plate connected eccentrically to said shaft by means of an eccentric hub in relation to the axis of the shaft and connecting feet connected to the orbital plate and die machine body, each of said connecting feet comprises an internal cylinder of hard plastic having an external rubber coating substantially surrounding said internal cylinder;

a rubber ring surrounding the feet structured to resist a reaction torque being applied to the plate from modifying an initial set up of the plate, said feet are disposed within said rubber ring; and a conveyor to provide an area that is protected from a dust.

5. The machine according to claim 4 wherein said internal cylinder of the connecting feet has an axial hole passing therethrough, a rod of rubber disposed within said axial hole, said rod of rubber is connected to end heads of said external coating located at opposite ends of said internal cylinder.

6. The machine according to claim 4, wherein each of said end heads has an externally disposed generally concave depression.

7. The machine according to claim 4, wherein said external rubber coating and said rod of rubber being unitary.

* * * * *